US010312044B2

(12) United States Patent
Hayashida et al.

(10) Patent No.: US 10,312,044 B2
(45) Date of Patent: Jun. 4, 2019

(54) ELECTROMAGNETIC RELAY

(71) Applicant: OMRON Corporation, Kyoto-shi, Kyoto (JP)

(72) Inventors: Yasuo Hayashida, Kumamoto (JP); Keisuke Yano, Kikuchi (JP); Ayaka Miyake, Kikuchi (JP); Masayuki Noda, Osaka (JP); Takeshi Nishida, Kusatsu (JP); Syuichi Itoda, Kusatsu (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 15/509,998

(22) PCT Filed: Jul. 27, 2015

(86) PCT No.: PCT/JP2015/071277
§ 371 (c)(1),
(2) Date: Mar. 9, 2017

(87) PCT Pub. No.: WO2016/088403
PCT Pub. Date: Jun. 9, 2016

(65) Prior Publication Data

US 2017/0301496 A1 Oct. 19, 2017

(30) Foreign Application Priority Data

Dec. 5, 2014 (JP) ..... 2014-247345

(51) Int. Cl.
*H01H 9/30* (2006.01)
*H01H 50/38* (2006.01)
(Continued)

(52) U.S. Cl.
CPC ..... *H01H 50/38* (2013.01); *H01H 50/02* (2013.01); *H01H 50/54* (2013.01); *H01H 50/58* (2013.01);
(Continued)

(58) Field of Classification Search
CPC ..... H01H 50/02; H01H 50/38; H01H 50/54; H01H 2205/002
(Continued)

(56) References Cited

U.S. PATENT DOCUMENTS 2,725,488 A 11/1955 Hueffed et al.
3,103,563 A 9/1963 Grenier
(Continued)

FOREIGN PATENT DOCUMENTS

CN 101388303 A 3/2009
CN 201311887 Y 9/2009
(Continued)

OTHER PUBLICATIONS

The U.S. Office action dated Mar. 12, 2018 in the related U.S. Appl. No. 15/509,914.
(Continued)

*Primary Examiner* — Shawki S Ismail
*Assistant Examiner* — Lisa N Homza
(74) *Attorney, Agent, or Firm* — Metrolexis Law Group, PLLC

(57) ABSTRACT

An electromagnetic relay includes a base, an electromagnetic block disposed on an upper surface of the base, a movable iron piece that rotates based on excitation/non-excitation of the electromagnetic block, a movable contact piece that rotates integrally with the movable iron piece, a movable contact fixed to a free end of the movable contact piece, a fixed contact disposed so as to come into or out of contact with the movable contact in association with rotation of the movable contact piece, and a magnetic field generation unit disposed so as to attract an arc generated between the movable contact and the fixed contact in a direction that, as seen from the fixed contact, is opposite to the movable contact and the base.

11 Claims, 17 Drawing Sheets

(51) Int. Cl.

| | |
|---|---|
| ***H01H 50/58*** | (2006.01) |
| ***H01H 50/54*** | (2006.01) |
| ***H01H 50/02*** | (2006.01) |
| ***H01H 50/60*** | (2006.01) |
| *H01H 50/42* | (2006.01) |

(52) U.S. Cl.
CPC ..... *H01H 50/60* (2013.01); *H01H 50/42* (2013.01); *H01H 2205/002* (2013.01); *H01H 2235/01* (2013.01)

(58) Field of Classification Search
USPC ..... 335/201
See application file for complete search history.

(56) References Cited

U.S. PATENT DOCUMENTS 3,364,450 A 1/1968 Conner
3,388,353 A 6/1968 Isler
3,441,800 A 4/1969 Lee
3,518,589 A * 6/1970 Koehler ..... H01H 50/04 335/132
3,544,929 A 12/1970 Di Marco et al.
3,688,230 A 8/1972 Tichy
3,745,492 A 7/1973 Grunert
3,942,144 A 3/1976 Contal
4,068,200 A 1/1978 Krueger
4,129,843 A 12/1978 Keller et al.
4,259,652 A 3/1981 Mattson
4,266,105 A 5/1981 Perkins, Jr.
4,307,361 A 12/1981 Grunert et al.
4,367,448 A * 1/1983 Nishizako ..... H01H 9/443 218/26
4,401,863 A 8/1983 Lemmer et al.
4,404,443 A * 9/1983 Coynel ..... H01H 1/62 218/23
4,475,094 A 10/1984 Grenier et al.
4,484,165 A 11/1984 Grenier et al.
4,529,953 A 7/1985 Myers
4,590,449 A 5/1986 VanTielen
4,631,507 A 12/1986 Guery et al.
4,644,308 A 2/1987 Guery et al.
4,688,011 A 8/1987 Lemmer et al.
4,713,636 A 12/1987 Lemmer et al.
4,808,952 A 2/1989 Berner et al.
4,931,757 A 6/1990 Lemmer et al.
4,973,929 A 11/1990 Duchemin
5,109,146 A 4/1992 Maenishi
5,119,053 A 6/1992 Mostosi
5,256,992 A 10/1993 Fasola et al.
5,293,521 A 3/1994 Blanchard et al.
5,500,630 A 3/1996 Edwards, Jr. et al.
5,502,426 A 3/1996 Blanchard et al.
5,517,167 A 5/1996 Yamamoto et al.
5,638,038 A 6/1997 Suzuki et al.
5,684,442 A 11/1997 Hufschmid
5,867,081 A 2/1999 Amoux et al.
5,986,529 A 11/1999 Miyata et al.
6,116,558 A * 9/2000 Yano ..... H01R 12/7011 248/27.3
6,911,884 B2 6/2005 Uotome et al.
6,956,728 B2 10/2005 Zhou et al.
7,098,763 B2 8/2006 Larcher
7,760,055 B2 7/2010 Adunka et al.
7,852,178 B2 12/2010 Bush et al.
7,859,373 B2 12/2010 Yamamoto et al.
7,915,985 B2 * 3/2011 Schmitz ..... H01H 9/443 218/22
8,138,440 B2 3/2012 Onufriyenko et al.
8,248,193 B2 8/2012 Kaneda et al.
8,791,777 B2 7/2014 Wan
9,064,664 B2 6/2015 Yamamoto et al.
9,532,476 B2 12/2016 Mills et al.
2003/0090351 A1 * 5/2003 Chen ..... H01H 9/42 335/132
2004/0109293 A1 6/2004 Apfelbacher et al.
2004/0257182 A1 * 12/2004 Saruwatari ..... H01H 50/08 335/129
2004/0263293 A1 * 12/2004 Saruwatari ..... H01H 50/326 335/128
2005/0007221 A1 * 1/2005 Saruwatari ..... H01H 50/08 335/128
2005/0052263 A1 * 3/2005 Saruwatari ..... H01H 50/08 335/17
2005/0242907 A1 * 11/2005 Minowa ..... H01H 50/443 335/129
2007/0126538 A1 6/2007 Liu
2009/0066450 A1 * 3/2009 Yano ..... H01H 49/00 335/203
2009/0072935 A1 3/2009 Yuba et al.
2010/0060394 A1 3/2010 Nagura et al.
2010/0066471 A1 * 3/2010 Nagura ..... H01H 9/047 335/201
2010/0165535 A1 7/2010 Pohl
2010/0265629 A1 10/2010 Beckerman
2011/0181381 A1 * 7/2011 Sasaki ..... H01H 9/443 335/78
2012/0206222 A1 * 8/2012 Gruner ..... H01H 1/54 335/177
2012/0313737 A1 12/2012 Iwamoto et al.
2013/0057369 A1 * 3/2013 Yano ..... H01H 1/66 335/156
2013/0240495 A1 * 9/2013 Yano ..... H01H 9/36 219/123
2013/0293324 A1 11/2013 Fujimoto et al.
2014/0225688 A1 * 8/2014 Masui ..... H01H 50/642 335/189
2014/0225689 A1 * 8/2014 Masui ..... H01H 50/642 335/194
2014/0265995 A1 9/2014 Kinsella et al.
2015/0042423 A1 * 2/2015 Hoffmann ..... H01H 50/541 335/133
2015/0055268 A1 2/2015 Chapel et al.
2015/0235791 A1 8/2015 Agarwal et al.
2017/0076893 A1 * 3/2017 Tsutsui ..... H01H 50/023
2017/0076894 A1 * 3/2017 Tsutsui ..... H01H 50/041
2017/0301494 A1 10/2017 Itoda et al.
2017/0301495 A1 * 10/2017 Hayashida ..... H01H 50/38
2017/0301496 A1 * 10/2017 Hayashida ..... H01H 50/38
2017/0309429 A1 * 10/2017 Hayashida ..... H01H 50/38

FOREIGN PATENT DOCUMENTS

CN 101667508 A 3/2010
CN 102129935 A 7/2011
CN 102820172 A 12/2012
CN 103367042 A 10/2013
CN 203983179 U 12/2014
JP S51-104337 U 8/1976
JP S56-37351 U 4/1981
JP S60-107551 U 7/1985
JP H01-103242 U 7/1989
JP H06-009102 U 2/1994
JP H10-214554 A 8/1998
JP 2000-299045 A 10/2000
JP 2009-224150 A 10/2009
JP 2010-177159 A 8/2010
JP 2012-221701 A 11/2012
JP 2013-080692 A 5/2013

OTHER PUBLICATIONS

The Chinese Office Action dated Mar. 30, 2018 in a related Chinese Patent application.
The Chinese Office Action dated Apr. 3, 2018 in a related Chinese Patent application.
The Chinese Office Action dated Apr. 4, 2018 in a counterpart Chinese Patent application.
The Japanese Office Action dated May 29 2018 in a related Japanese application.

(56) References Cited

OTHER PUBLICATIONS

The Office Action dated Dec. 12, 2018 in a counterpart Chinese Patent application.

* cited by examiner

ELECTROMAGNETIC RELAY

TECHNICAL FIELD

The present invention relates to an electromagnetic relay, and especially to an electromagnetic relay capable of effectively extinguishing a generated arc.

BACKGROUND ART

As a conventional electromagnetic relay, for example, there has been disclosed an electromagnetic relay including: an armature which tilts by excitation and non-excitation of an electromagnetic block; a movable contact portion which has a movable contact, is mounted on the armature, and tilting together with tilting of the armature; and a fixed contact portion having a fixed contact with which the movable contact comes into or out of contact. In the electromagnetic relay, an arc extension space is formed to extend an arc that is generated when the movable contact comes into or out of contact with the fixed contact, and a magnetic field generation unit is provided to guide, to the arc extension space, an arc that is generated when the movable contact comes into or out of contact with the fixed contact (cf. PTL 1).

In the above electromagnetic relay, as shown in FIGS. 7A and 7B, a fixed contact 22*a* is disposed at an upper surface edge of a base 30, and a movable contact 21*a* is disposed inside the fixed contact 22*a*. The electromagnetic relay is configured such that, an arc, generated between the movable contact 21*a* and the fixed contact 22*a*, is attracted upward by magnetic force of a permanent magnet 50 and extended longer, to thereby be eliminated.

CITATION LIST

Patent Literature

PTL 1 Japanese Unexamined Patent Application Publication No. 2013-80692

SUMMARY OF INVENTION

Technical Problems

However, in the above electromagnetic relay, each permanent magnet is disposed between adjacent fixed contacts so as to extend the arc upward. This causes the problem of increasing a width dimension of the electromagnetic relay (a dimension in a direction in which the fixed contacts are adjacent).

Further, due to the need for extending the arc high upward, it is necessary to dispose a tall permanent magnet, thus causing the problem of impeding the reduction in height of the electromagnetic relay.

In view of the above problems, an object of the present invention is to provide an electromagnetic relay that is small in a width dimension, and short in height.

Solution to Problem

An electromagnetic relay according to the present invention, comprises:

a base;

an electromagnetic block disposed on an upper-surface of the base;

a movable iron piece that rotates based on excitation and non-excitation of the electromagnetic block;

a movable contact piece that rotates integrally with the movable iron piece;

a movable contact fixed to a free end of the movable contact piece;

a fixed contact disposed so as to come into or out of contact with the movable contact in association with rotation of the movable contact piece; and a magnetic field generation unit disposed so as to attract an arc generated between the movable contact and the fixed contact in a direction that, as seen from the fixed contact or the movable contact, is opposite to a facing movable contact or a facing fixed contact, and in a direction opposite to the base.

Advantageous Effects of Invention

According to the present invention, the magnetic field generation unit is disposed so as to attract the arc generated between the movable contact and the fixed contact in a direction that, as seen from the fixed contact or the movable contact, is opposite to the facing movable contact or the facing fixed contact, and in a direction opposite to the base. This eliminates the need for disposing the permanent magnet in a width dimension of the electromagnetic relay (a vertical direction to a direction in which the fixed contact and the movable contact come into or out of contact with each other, and a parallel direction to the base), thus enabling an electromagnetic relay with a small width dimension to be obtained. In addition to this, the arc is attracted in the direction that, as seen from the fixed contact or the movable contact, is opposite to the facing movable contact or the facing fixed, contact, and in the direction opposite to the base. That is, the arc is attracted obliquely backward as seen from the fixed contact or the movable contact, thereby eliminating the need for disposing a rail permanent magnet as in the conventional example, to enable a short, small electromagnetic relay to be obtained.

As an embodiment of the present invention, the movable contact piece may have a substantially T-shape with a large width portion at a tip, and a plurality of the movable contacts may be each fixed to the free end of the large width portion.

According to the present embodiment, since the generated arc is attracted obliquely backward as seen from the fixed contact or the movable contact, the arc is hard to come into contact with the movable contact piece itself, and there is thus an advantage in being able to prevent deterioration in the movable contact piece.

As another embodiment of the present invention, the magnetic field generation unit may be made up of a permanent magnet and an auxiliary yoke, and the auxiliary yoke may be disposed so as to be adjacent to the permanent magnet, while the permanent magnet is disposed in a direction in which the fixed contact and the movable contact come into and out of contact with each other. According to the present embodiment, it is possible to change a direction of a magnetic force line of the permanent magnet via the auxiliary yoke. That is, by adjusting the shape or the position of the auxiliary yoke, the attracting direction of the arc generated between the fixed contact and the movable contact can be adjusted to a desired direction. Further, by making the auxiliary yoke adjacent to the permanent magnet, the leakage of a magnetic flux of the permanent magnet is reduced to improve the magnetic efficiency, thus enabling reduction in size of the permanent magnet.

As a different embodiment of the present invention, an arc extinguishing space may be disposed on the upper surface of the base, the space being located in a direction that, as seen from the fixed contact or the movable contact, is opposite to a facing movable contact or a facing fixed contact.

According to the present embodiment, it is possible to extend the arc long in the arc extinguishing space, and thereby to efficiently extinguish the arc.

As a different embodiment of the present invention, the arc extinguishing space may be formed between a partition wall provided, on the upper surface of the base and a terminal hole for disposing on the base a fixed contact terminal on which the fixed contact is disposed.

According to the present embodiment, damage on internal components can be prevented by the partition wall, thus enabling an electromagnetic relay with a long lifetime to be obtained.

As a new embodiment of the present invention, a metal arc cut-off member may be disposed in the arc extinguishing space.

According to the present embodiment, the generated arc is rapidly cooled by the arc cut-off member and then extinguished, and it is thus possible to obtain an electromagnetic relay capable of more efficiently extinguishing the arc.

As another embodiment of the present invention, the electromagnetic relay may comprise:

a plurality of pairs of the movable contacts and the fixed contacts;

a first magnetic field generation unit disposed so as to attract an arc generated between a first movable contact and a first fixed contact in a direction that, as seen, from the first movable contact or the first fixed contact, is opposite to a facing first fixed contact or a facing first movable contact, and in a direction opposite to the base; and a second magnetic field generation unit disposed so as to attract an arc generated between a second movable contact and a second fixed contact and an arc generated between a third movable contact and a third fixed, contact in an opposite direction to each other.

According to the present embodiment, by use of a plurality of permanent magnets, the generated arc can be attracted in a variety of directions to increase the flexibility in designing, and a dead space can be effectively used to reduce the size of the electromagnetic relay.

As another embodiment of the present invention, the second movable contact and the third movable contact, and the second fixed contact and the third fixed contact, may be disposed so as to respectively be adjacent to each other, and the second magnetic field generation unit may attract the arc generated between the second movable contact and the second fixed contact toward the upper surface of the base, and attracts the arc generated between the third movable contact and the third fixed contact in a direction opposite to the upper surface of the base.

According to the present embodiment, by use of magnetic force of the second permanent magnet, there is an effect in that an arc generated between a specific movable contact and fixed contact, out of a plurality of pairs of movable contacts and fixed contacts, can be attracted in a predetermined direction to further increase the flexibility in designing, and a dead space can be effectively used to further reduce the size of the electromagnetic relay.

DESCRIPTION OF EMBODIMENTS

Figure 1A:
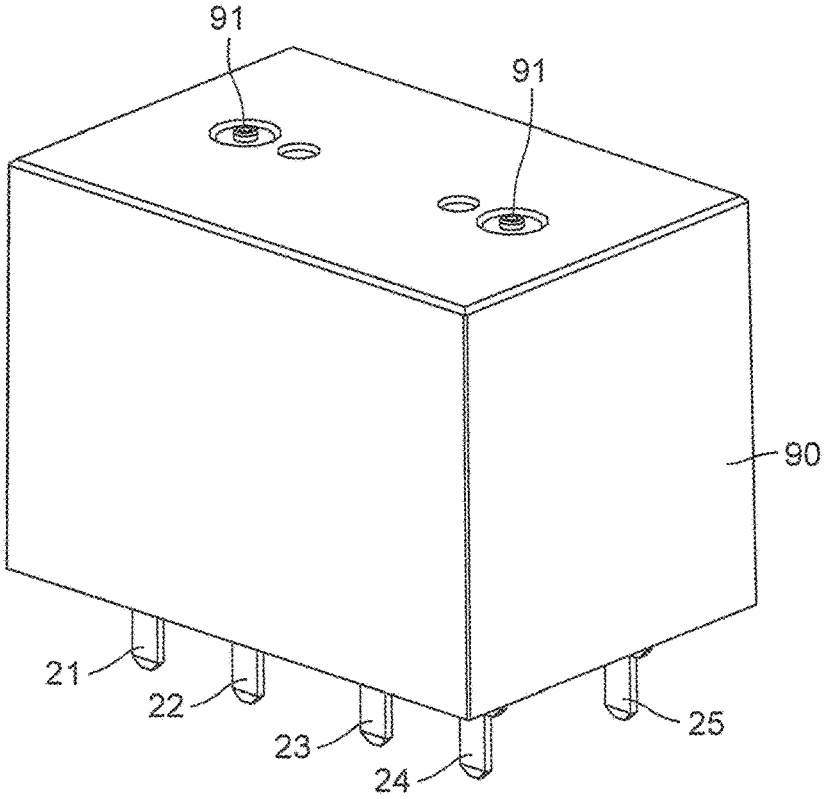
FIGS. 1A and 1B are overall perspective views of an electromagnetic relay according to the present invention, respectively seen from obliquely above and from obliquely below.
Figure 1B:
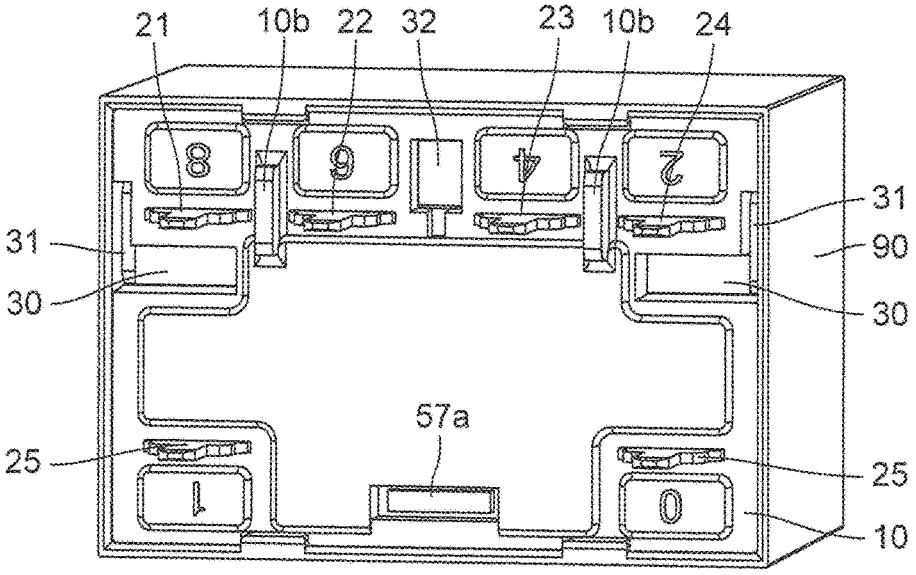
Figure 2A:
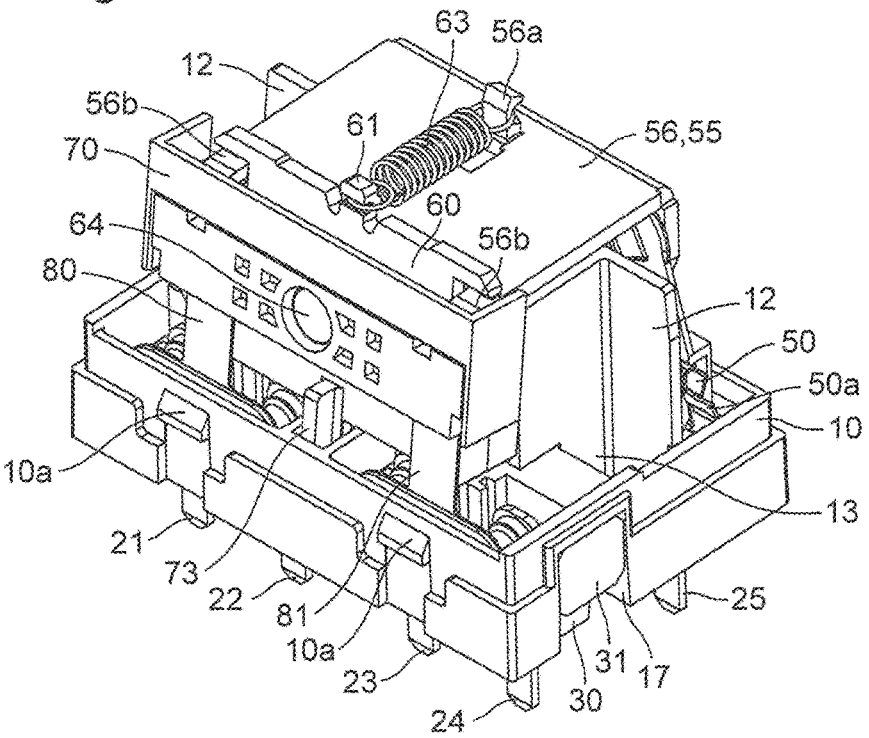
FIGS. 2A and 2B are overall perspective views of the electromagnetic relay according to the present invention with a cover removed therefrom, respectively seen from obliquely above and from obliquely below.
Figure 2B:
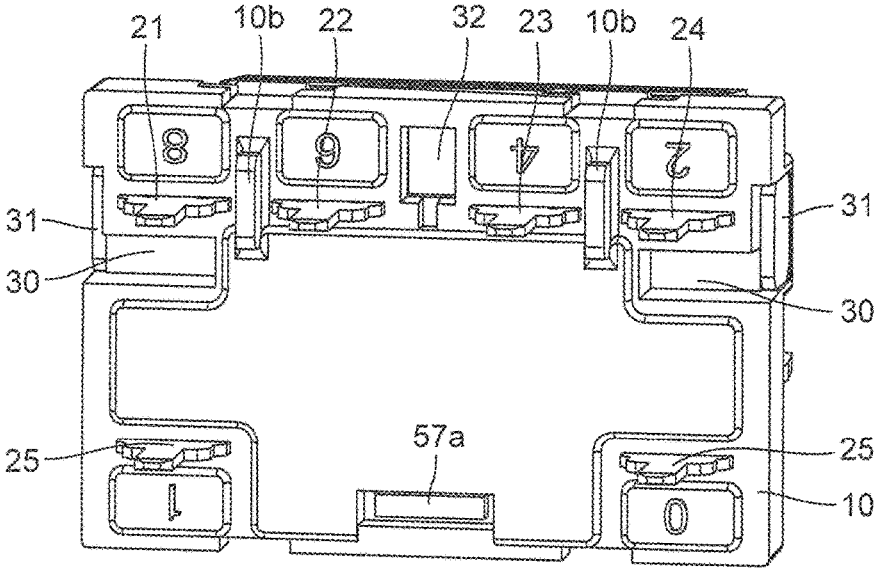

Electromagnetic relays of an embodiment according to the present invention are described in accordance with attached drawings of FIGS. 1A to 1B.

Figure 3:
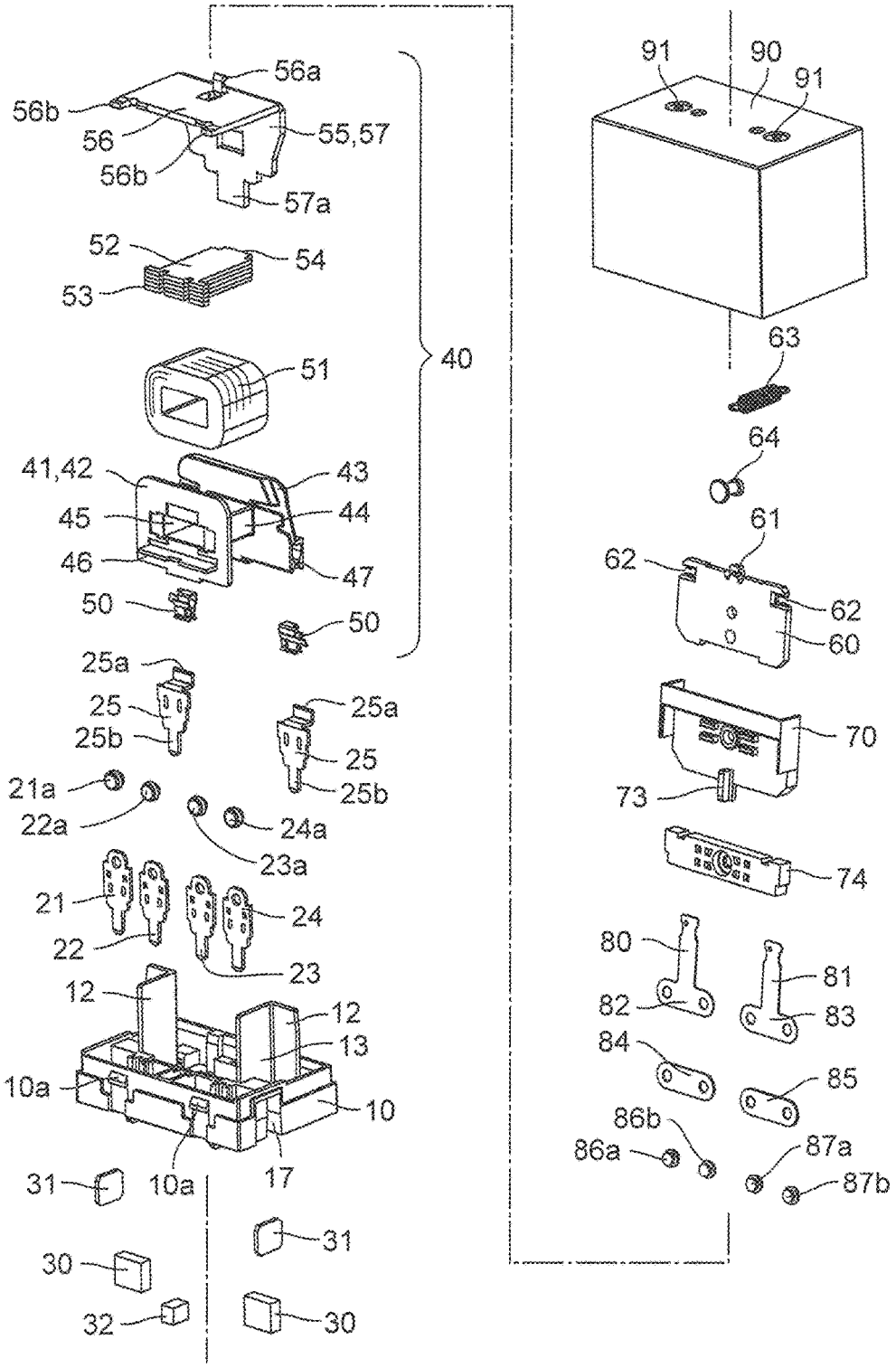
FIG. 3 is an exploded perspective view of the electromagnetic relay shown in FIGS. 1A and 1B, seen from obliquely above.
Figure 4:
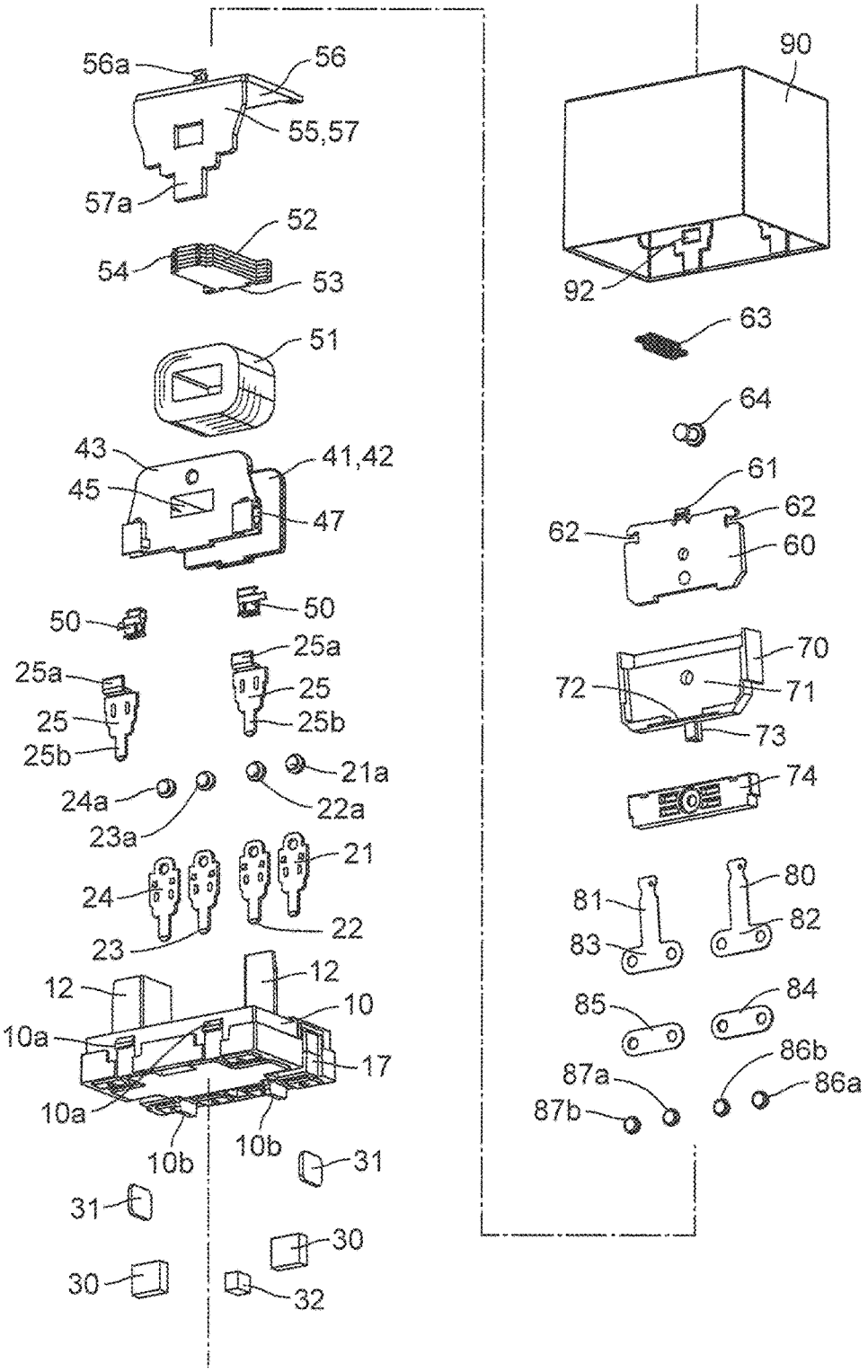
FIG. 4 is an exploded perspective view of the electromagnetic relay shown in FIGS. 1A and 1B, seen from obliquely below.

An electromagnetic relay according to the embodiment are roughly configured of a base 10, fixed contact terminals 21 to 24, a magnetic field generation unit 35, an electromagnetic block 40, a movable iron piece 60, movable contact pieces 80, 81, and a cover 90, as shown in FIGS. 3 and 4.

Figure 10A:
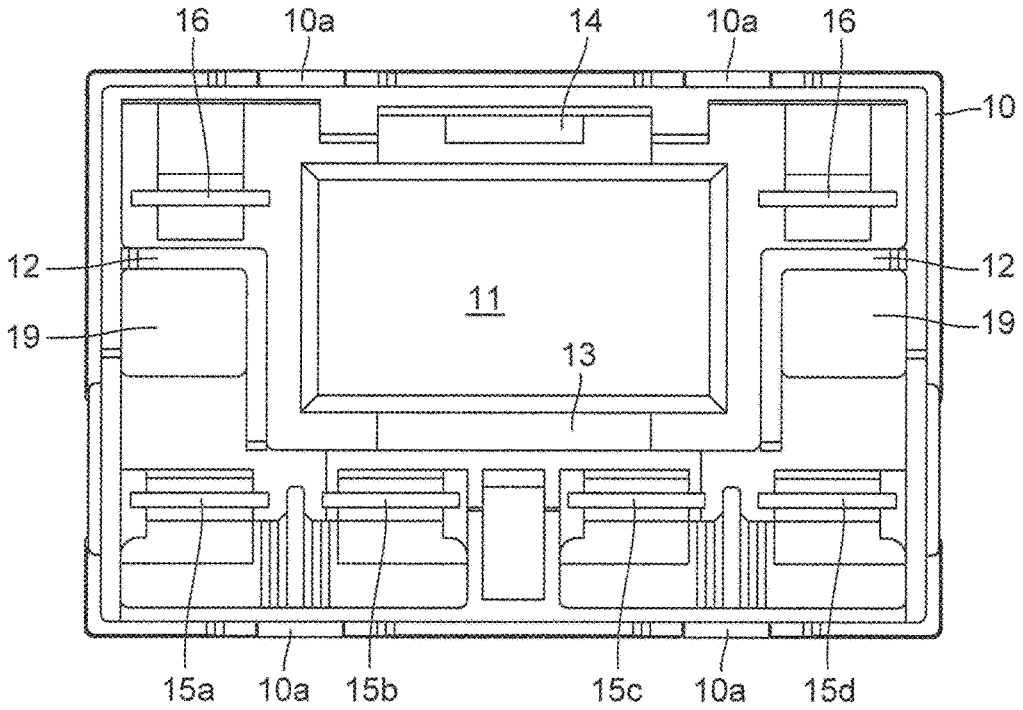
FIGS. 10A and 10B are a plan view and a bottom view of a base.

As shown in FIG. 10A, in the base 10, a pair of partition walls 12, 12 having an L-shape in cross section is provided to project from both right and left sides of a recessed portion 11 provided at the center of the upper surface. Further, in the base 10, one edge of edges vertically facing each other with the recessed portion 11 placed therebetween is provided with a stepped portion 13, and the other edge is provided with a press-fitting hole 14. The stepped portion 13 is for supporting a spool 41 of the electromagnetic block 40 described later. The press-fitting hole 14 is for press-fitting the lower end 57*a* of a yoke 55 of the electromagnetic block 40 in. In the base 10, terminal holes 15*a* to 15*d* are provided on the same straight line along one edge of edges facing each other on the upper surface, and terminal holes 16, 16 are provided along the other edge. Then, in the base 10, arc extinguishing spaces 19, 19 are respectively formed between the partition walls 12, 12 and the terminal holes 15*a*, 15*d*. Moreover, in the base 10, a pair of engaging claw portions 10*a* is formed on each of the outer side surfaces facing each other with the partition walls 12, 12 placed therebetween.

According to the present embodiment, there is an advantage that an increase in size of the electromagnetic relay can be avoided by effectively using the dead space of the base 10 as the arc extinguishing space 19.

Figure 10B:
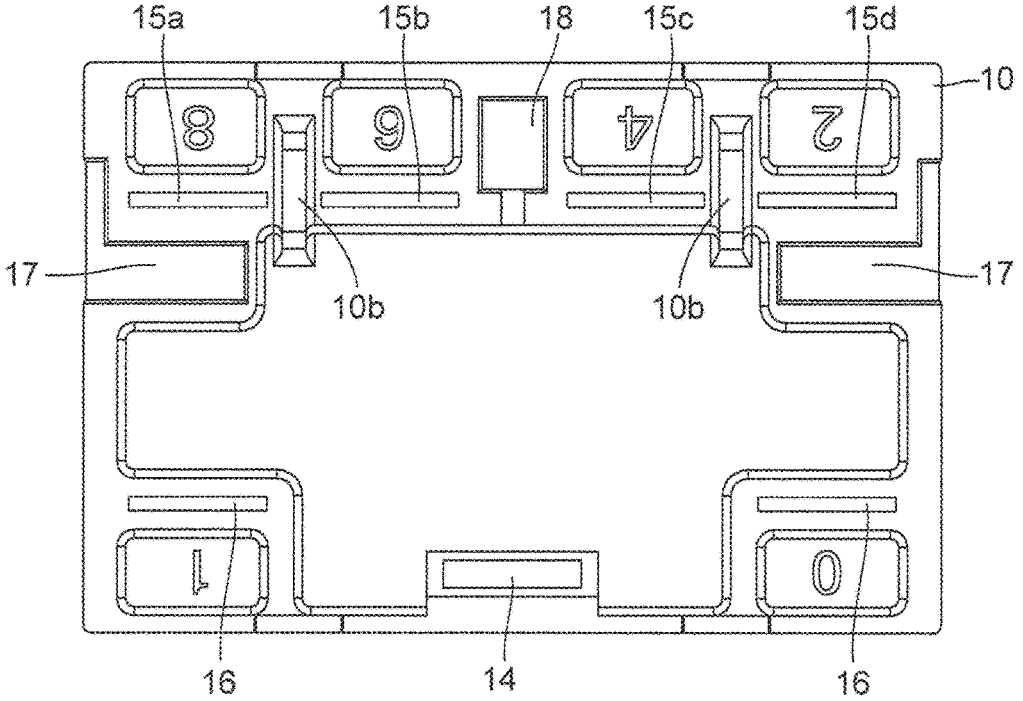

In the lower surface of the base 10, as shown in FIG. 10B, substantially L-shaped notched grooves 17, 17, which are recessed portions, are respectively provided behind the terminal holes 15*a*, 15*d* where the fixed contact terminals 21, 24 are to be inserted (in the direction opposite to a direction in which movable contacts 86*a*, 87*b* described later are installed as seen from the terminal holes 15*a*, 15*d*). Part of the notched groove 17 communicates with the outside from the side surface of the base 10, and is able to house a first permanent magnet 30 and an auxiliary yoke 31 described later. Further, in the base 10, a recessed portion 18 for housing a second permanent magnet 32 described later is provided between the terminal holes 15*b*, 15*c*. Then, in the base 10, a pair of ribs 10*b*, 10*b* is provided to project from the lower surface so as to prevent the electromagnetic relay according to the present invention from being inclined when mounted on a substrate.

Figure 13A:
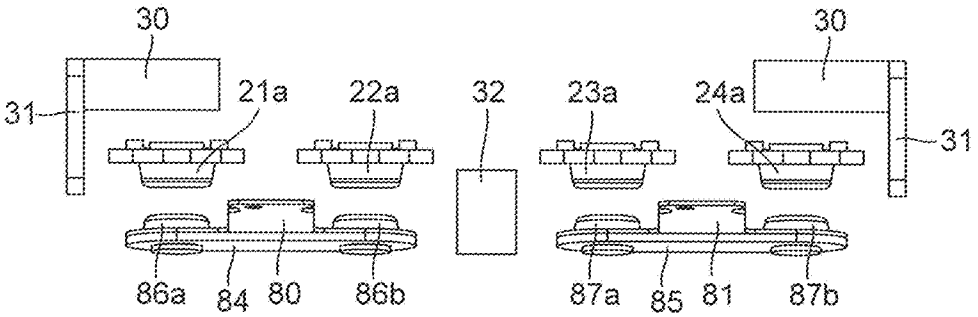
FIGS. 13A and 13B are a schematic plan view and a schematic front view showing a contact mechanism.
Figure 13B:
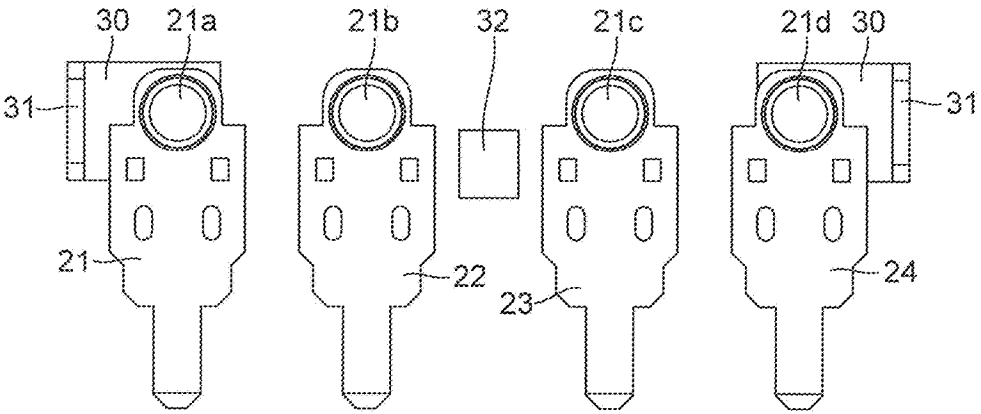

As shown in FIGS. 13A and 13B, the fixed contact terminals 21 to 24 (FIGS. 3 and 4) have the fixed contacts 21*a* to 24*a* fixed to the upper ends thereof, and has terminal portions 21*b* to 24*b* at the lower ends thereof. The terminal portions 21*b* to 24*b* are then inserted into the terminal holes 15*a* to 15*d* (FIGS. 10A and 10B) of the base 10, and the fixed contacts 21*a* to 24*a* are thereby aligned on the same straight line. The four fixed contacts 21*a* to 24*a* are disposed in this manner for the purpose of reducing a load voltage to be applied to each of the four fixed contacts 21*a* to 24*a*. Hence, it is possible to prevent generation of an arc at the time of opening or closing of a DC power supply circuit.

As shown in FIGS. 3 and 4, the coil terminal 25 has a bent connection portion 25*a* on the upper end portion thereof, and has a terminal portion 25*b* on the lower end portion thereof. The terminal portions 25*b* is then pressed into the terminal hole 16 (FIGS. 10A and 10B) of the base 10, and the coil terminals 25, 25 are thereby aligned on the same straight line.

As shown in FIGS. 3, 4, 13A, and 13B, the magnetic field generation unit 35 is made up of the first permanent magnet 30, the auxiliary yoke 31, and the second permanent magnet 32. Then, the first permanent magnet 30 is disposed in a direction in which the fixed contacts 21*a*, 24*a* and the movable contacts 86*a*, 87*b* come into or out of contact with each other, namely in the direction opposite to the movable contacts 86*a*, 37*b* as seen from the fixed contacts 21*a*, 24*a* (FIG. 6B). Further, the auxiliary yoke 31 is disposed so as to be adjacent to the first permanent magnet 30 (FIG. 6B). The second permanent magnet 32 (FIG. 7B) is then disposed between the fixed contact 22*a* and the fixed contact 23*a* shown in FIG. 6B.

Directions of magnetic poles of the first permanent magnet 30 and the second permanent magnet 32 are set corresponding to a direction of a current that flows between the fixed, contacts 21*a* to 24*a* and the movable contacts 86*a*, 86*b*, 87*a*, 87*b* when fixed contact terminals 22, 23 are electrically connected. Hence, the first permanent magnet 30, the auxiliary yoke 31, and the second permanent magnet 32 can attract arcs respectively generated between the fixed contacts 21*a*, 22*a*, 23*a*, 24*a* and the movable contacts 86*a*, 86*b*, 87*a*, 87*b* in predetermined directions to extend and extinguish the arcs.

In particular, by adjusting the shape or the position of the auxiliary yoke 31, magnetic force lines of the first permanent magnet 30 can be changed in desired directions. It is thus possible to prevent leakage of a magnetic flux of the first permanent magnet 30 in the first permanent magnet 30 while adjusting the arc attracting direction, thereby to enhance the magnetic efficiency. Thus, in order to obtain such effects, the auxiliary yoke 31 is provided.

Figure 6A:
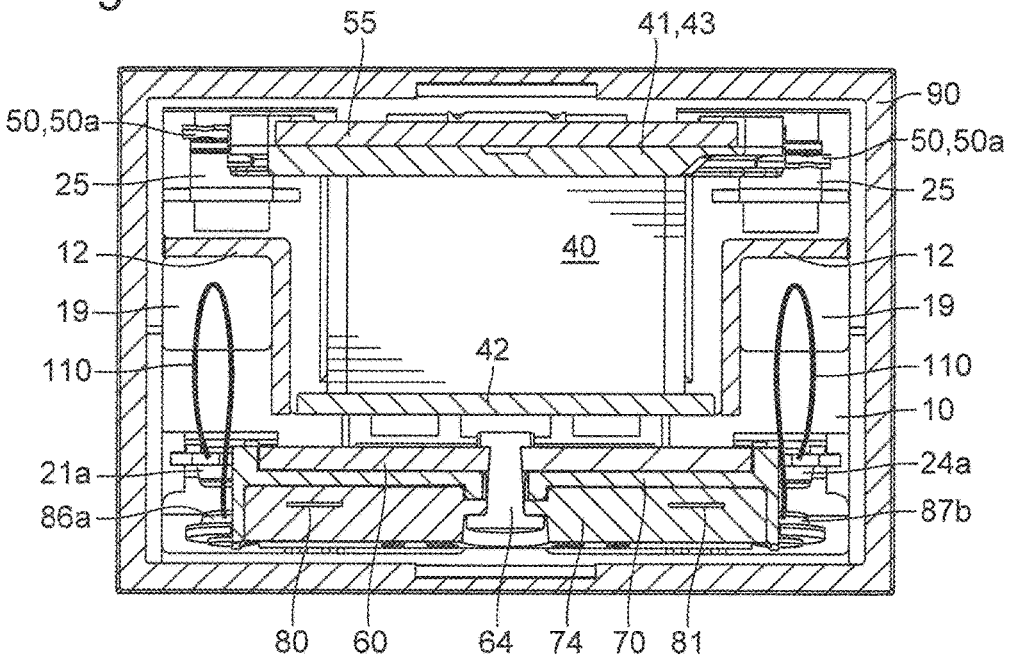
FIGS. 6A and 6B are horizontal sectional views obtained by cutting the electromagnetic relay at different positions.
Figure 6B:
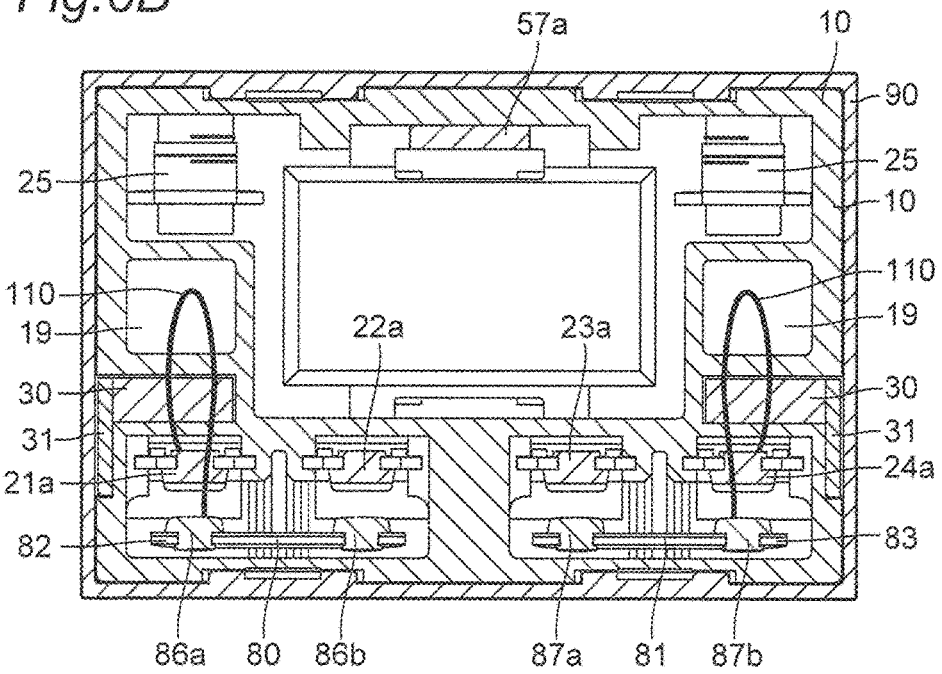

That is, as shown in FIGS. 6A and 6B, the first permanent magnet 30 and the auxiliary yoke 31 are disposed so as to generate magnetic force lines that can attract the arc generated between the fixed contact 21*a* and the movable contact 86*a* in the direction opposite to the movable contact 86*a* as seen from the fixed contact 21*a*.

Further, the first permanent magnet 30 and the auxiliary yoke 31 are disposed so as to generate magnetic force lines that can attract the arc generated between the fixed contact 24*a* and the movable contact 87*b* in the direction opposite to the movable contact 87*b* as seen from the fixed contact 24*a*.

The second permanent magnet 32 is disposed so as to generate magnetic force lines that can attract the arc generated between the fixed contact 22*a* and the movable contact 86*b* so as to move to the upper surface of the base 10.

Further, the second permanent magnet 32 is disposed so as to generate magnetic force lines that can attract the arc generated between the fixed contact 23*a* and the movable contact 87*a* in the direction opposite to the upper surface of the base 10.

Note that the electromagnetic relay according to the present embodiment has four poles. However, in the present embodiment, the arc generated between the facing fixed contact 22*a* and movable contact 86*b* and the arc generated between the facing fixed contact 23*a* and movable contact 87*a* can be attracted by three permanent magnets in predetermined directions. Hence, there is an advantage that the number of components is smaller than in the conventional case.

In the present embodiment, the description has been given of the configuration where, as shown in FIG. 6B, the generated arc is attracted so as to move obliquely upward in the direction opposite to the movable contact 86*a* and the movable contact 87*b* as seen from the fixed contacts 21*a*, 24*a*. However, this is not restrictive, and the positions of the fixed contact 21*a* and the movable contact 86*a*, or the positions of the fixed contact 24*a* and the movable contact 87*b*, may be reversed. When the positions are reversed in this manner, the directions of magnetic poles of the first permanent magnet 30 and the second permanent magnet 32 can be appropriately set corresponding to the direction of a current that flows between the fixed contacts 21*a*, 22*a*, 23*a*, 24*a* and the movable contacts 86*a*, 86*b*, 87*a*, 87*b* when the fixed contact terminals 22, 23 are electrically connected, it is thus possible to attract the generated arc so as to move obliquely upward in the direction opposite to the fixed contacts 22*a*, 23*a* as seen from the movable contact 86*a* and the movable contact 87*b*.

In the present embodiment, the first permanent magnet 30 having large magnetic force and the second permanent magnet 32 having small magnetic force are combined. That is, the magnetic force of the first permanent magnet 30 is larger than the magnetic force of the second permanent magnet 32. This is for preventing generation of the arcs between the fixed contacts 22*a*, 23*a* and the movable contacts 86*b*, 87*a*, and respectively attracting the arcs generated between the fixed contacts 21*a*, 24*a* and the movable contacts 86*a*, 87*b* to the arc extinguishing spaces 19, 19, to efficiently extinguish the arcs. Note that the second permanent magnet 32 may be provided as necessary.

Then, the first permanent magnet 30 and the auxiliary yoke 31 are inserted into the notched groove 17 (FIGS. 10A and 10B) provided on the base 10. The auxiliary yoke 31 is thereby positioned so as to be adjacent to the first permanent magnet 30. The second permanent magnet 32 is housed into the recessed portion 18 provided in the base 10.

According to the present embodiment, the first and second permanent magnets 30, 32 and the auxiliary yoke 31 are assembled from the lower surface of the base 10. Hence, it is possible to prevent deterioration in the first and second permanent magnets 30, 32 and the auxiliary yoke 31 caused by the generated arc. Further, since the thickness dimension of the base 10 is effectively usable, it is possible to obtain a space-saving electromagnetic relay.

Note that all of the first permanent magnet 30, the auxiliary yoke 31, and the second permanent magnet 32 are not necessarily required to be assembled from the lower surface of the base 10, but may be assembled from the upper surface of the base 10 as needed.

Further, the permanent magnet, or the permanent magnet and the auxiliary yoke, may be disposed behind each of the fixed contacts 21*a* to 24*a*.

Figure 11A:
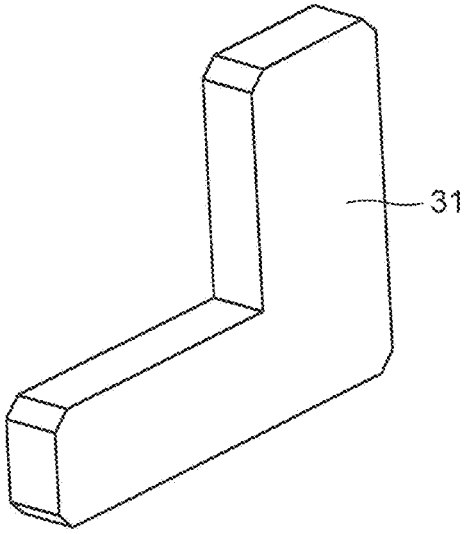
FIGS. 11A and 11B are a perspective view and a right side view showing a modified example of an auxiliary yoke.
Figure 11B:
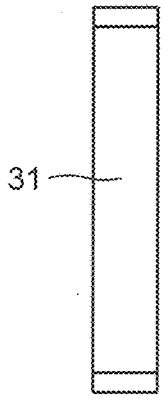

The foregoing auxiliary yoke 31 is not restricted to the rectangular-shaped platy magnetic member, but may, for example, have a substantially L-shape in front view (FIGS. 11A and 11B). According to this modified example, directions of the magnetic force lines of the first permanent magnet 30 can be changed to directions different from those in the case of using the rectangular-shaped platy magnetic member. Thus, the arc attracting direction can be changed in a desired direction by appropriately adjusting the shape and the position of the auxiliary yoke 31.

Figure 11C:
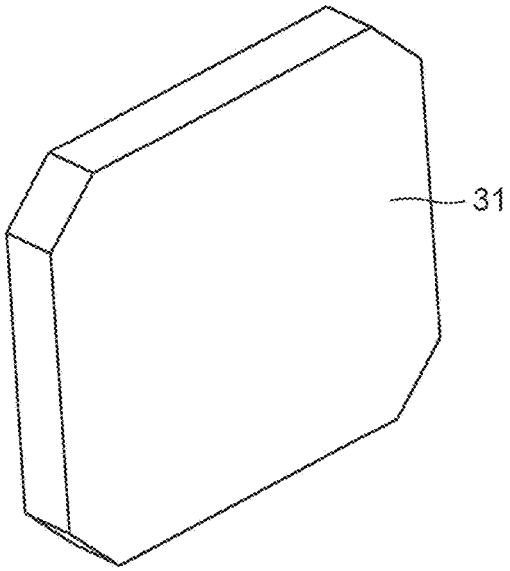
FIGS. 11C and 11D are a perspective view and a right side view showing; another modified example of the auxiliary yoke.
Figure 11D:
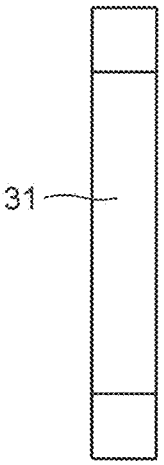

Further, the foregoing auxiliary yoke 31 may be a rectangular platy magnetic member with chamfered corners (FIGS. 11C and 11D). With the corners chamfered, this modified example has the advantage of being more easily inserted into the notched groove 17 and improving the ease of assembly.

Figure 12A:
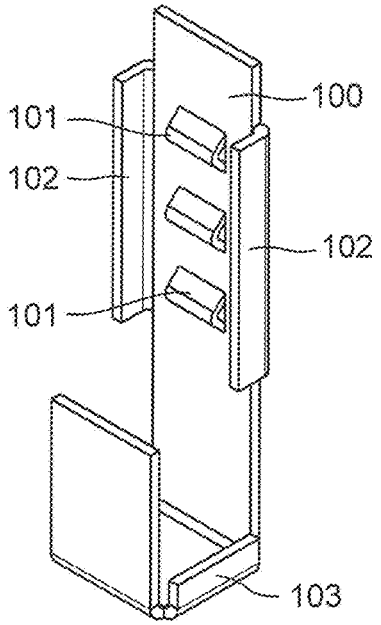
FIGS. 12A and 12B are a perspective view and a longitudinal sectional view showing an arc cut-off member.
Figure 12B:
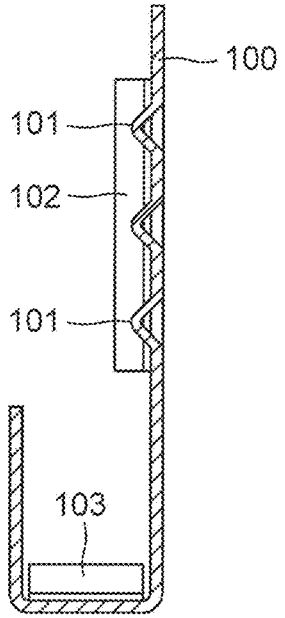

In the arc extinguishing space 19, for example, an arc cut-off member 100 as shown in FIGS. 12A and 12B may be disposed. This is for rapidly cooling the generated arc and effectively extinguishing the arc.

The arc cut-off member 100 is formed by bending a strip metal plate to have a substantially J-shape in cross section. A plurality of projections 101 being substantially triangular in cross section are provided to project from the front surface of arc cut-off member 100. The projections 101 is for expanding a contacting area with the arc to enhance the rapid cooling efficiency. At both-side edges of the front surface of the arc cut-off member 100, ribs 102 are bent and raised so as to face each other. Further, at both-side edges of the bottom surface of the arc cut-off member 100, ribs 103 are bent and raised so as to face each other. The ribs 102, 103 are for preventing leakage of the generated arc from the arc extinguishing space 19.

Figure 12C:
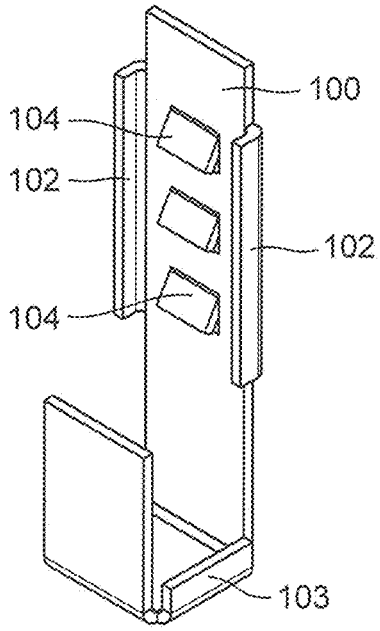
FIGS. 12C and 12D are a perspective view and a longitudinal sectional view showing another modified example of the auxiliary yoke.
Figure 12D:
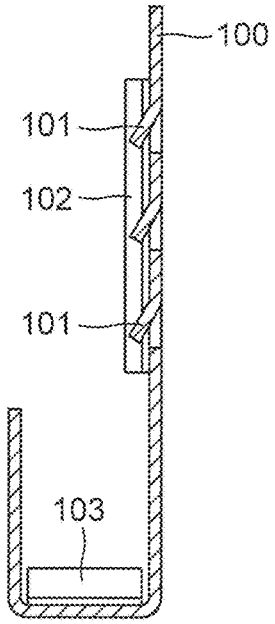

As another arc cut-off member 100, for example as shown in FIGS. 12C and 12D, a plurality of tongue members 104 may be cut and raised on the front surface. Since the others are the same as those of the foregoing arc cut-off member 100, the same portions are provided with the same numerals and descriptions thereof are omitted. Note that the arc cut-off member may simply be made of metal, and is not restricted to the metal plate.

As shown in FIGS. 3 and 4, the electromagnetic block 40 is formed of a spool 41, a coil 51, an iron core 52, and a yoke 55.

Figure 7A:
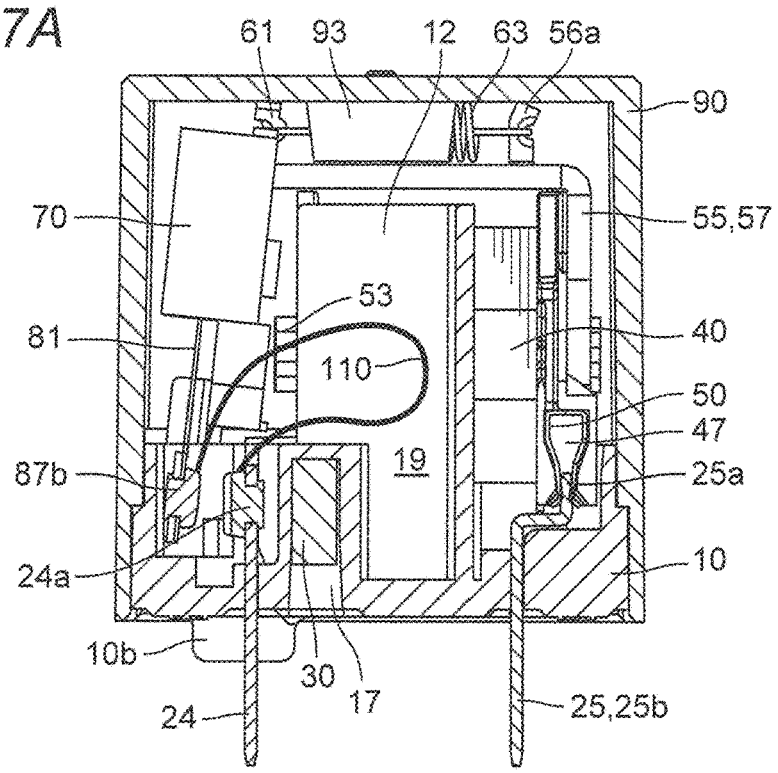
FIGS. 7A and 7B are longitudinal sectional views obtained by cutting the electromagnetic relay at different positions.
Figure 7B:
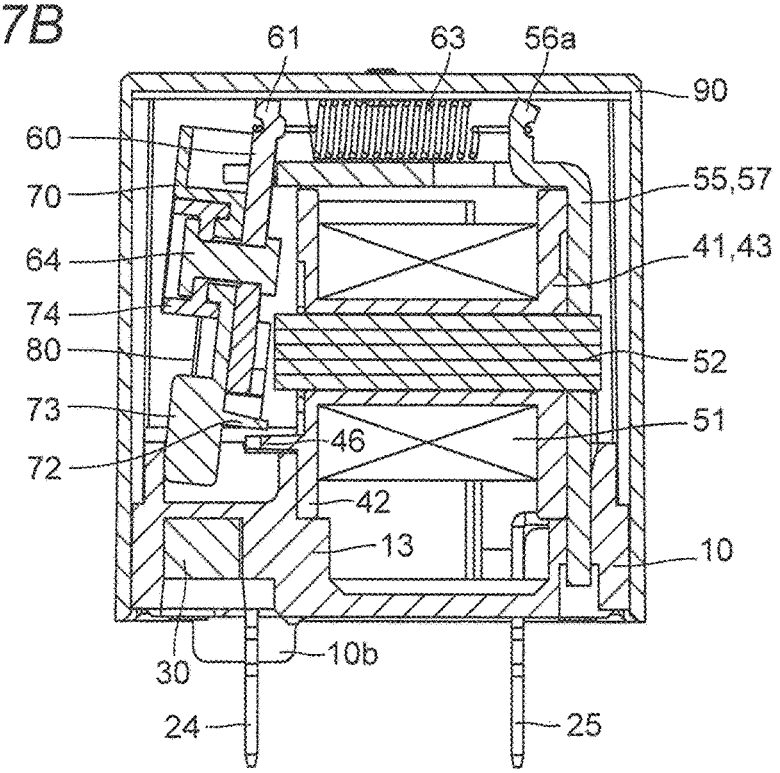

In the spool 41, a through hole 45 being rectangular in cross section is provided in a trunk portion 44 having flange portions 42, 43 at both ends, and an insulating rib 46 is provided to laterally project from the outward surface of one flange portion 42. Further, the removal of the spool 41 is prevented by engaging relay clips 50 into engaging holes 47 provided at both-side edges of the other flange portion 43 (FIG. 7B).

As shown in FIG. 3, the coil 51 is wound around the trunk portion. 44, and a leader line of the coil 51 is bound and soldered to a binding portion 50*a* (FIG. 6A) extending from the relay clip 50.

As shown in FIG. 3, the iron core 52 is formed by laminating a plurality of platy magnetic members having a substantially T-shape in planar view. The iron core 52 is then put through the through hole 45 of the spool 41. One protruding end of the iron core 52 is taken as a magnetic pole portion 53, and the other protruding end 54 is crimped and fixed to a vertical portion 57 of the yoke 55 having a substantially L-shape in cross section which is described later.

The yoke 55 is made of a magnetic plate that is bent to have a substantially L-shape in cross section. In the yoke 55, an engaging projection 56*a* is bent and raised at the center of a horizontal portion 56, and supporting projections 56*b* are cut and raised at both-side edges of the tip of the horizontal portion 56. Further, the yoke 55 is formed in such a shape that the lower end 57*a* of the vertical portion 57 can be press-fitted into the press-fitting hole 14 of the base 10.

The movable iron piece 60 is made of a platy magnetic member. As shown in FIGS. 3 and 4, in the movable iron piece 60, an engaging projection 61 is provided to project from the upper-side edge, and notched portions 62, 62 are provided at both-side edges.

In the movable iron piece 60, the notched portion 62 is engaged to the supporting projections 56*b* of the yoke 55. Further, the movable iron piece 60 is rotatably supported by coupling the engaging projection 61 to the engaging projection 56*a* of the yoke 55 via a restoring spring 63.

The movable contact pieces 80, 81 each have a substantially T-shape in front view, and the movable contacts 86*a*, 86*b*, 87*a*, 87*b* are fixed at both ends of large width portions 82, 83 of the movable contact pieces 80, 81 via conductive lining members 34, 85. The lining members 84, 85 substantially increase sectional areas of the large width portions 82, 83 to reduce electric resistance and suppress heat generation. Further, as described above, the arc is attracted so as to move obliquely upward in the direction opposite to the movable contact 86*a* and the movable contact 87*b*, as seen from the fixed, contacts 21*a*, 24*a*. Accordingly, the generated arc is hard to come into contact with the movable contact pieces 80, 81 themselves, movable contact pieces 80, 81 caused by the arc.

The movable contact pieces 80, 81 are integrally formed by insert-molding of the top ends thereof with a movable stage 74. Then as shown in FIG. 7*b* the movable stage 74 is integrally formed with a spacer 70 and the movable iron piece 60 via a rivet 64. As shown in FIG. 4, the spacer 70 enhances insulating properties of the movable iron piece 60 by fitting of the movable iron piece 60 into a recessed portion 71 provided on the inward surface of the spacer 70. In the spacer 70, an insulating rib 72 (FIGS. 3 and 7B) is provided at the lower-side edge of the inward surface, and an insulating rib 73 (FIGS. 3 and 7B) for separating the movable contact pieces 80, 81 is provided to laterally project from the lower-side edge of the outward surface.

Figure 8A:
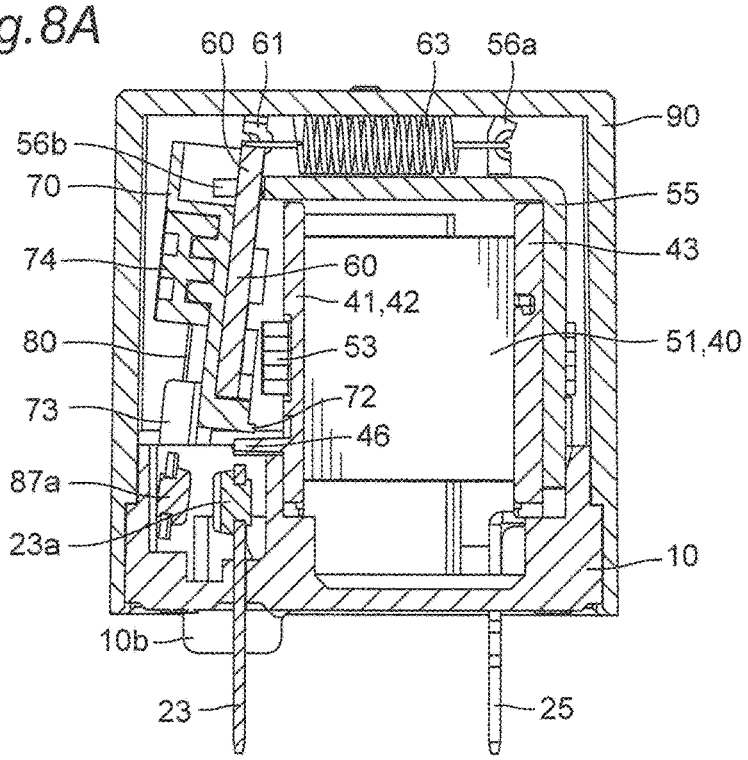
FIGS. 8A and 8B are a longitudinal sectional view and a partially enlarged longitudinal sectional view of the electromagnetic relay.
Figure 8B:
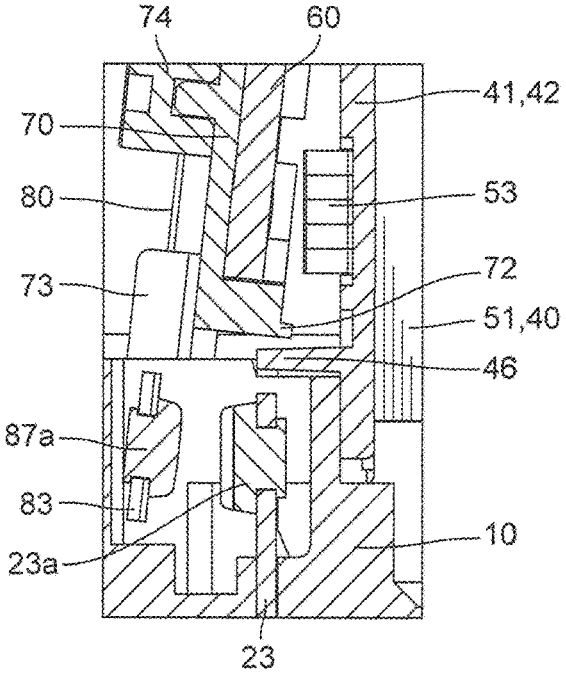

Then, the electromagnetic block 40 mounted with the movable contact pieces 80, 81 is housed into the base 10, and a flange portion 42 of the spool 41 is placed on the stepped portion 13 (FIG. 7B) of the base 10. Then, the lower end 57*a* of the yoke 55 is press-fitted into the press-fitting hole 14 of the base 10 and positioned. Accordingly, the relay clips 50 of the electromagnetic block 40 pinch a connection portion 25*a* of the coil terminal 25 (FIG. 7A). Further, the movable contacts 86*a*, 86*b*, 87*a*, 87*b* contactably and separably face the fixed contacts. 21*a*, 22*a*, 23*a*, 24*a*, respectively. As shown in FIG. 8B, the insulating rib 72 of the spacer 70 is located in the upper vicinity of the insulating rib 46 of the spool 41.

Specifically, at least either the insulating rib 46 or 72 is disposed so as to cut off the shortest-distance straight line connecting between each of the fixed contacts 22*a*, 23*a* (or the fixed contact terminals 22, 23) and the magnetic pole portion 53. This leads to an increase in spatial distance from the magnetic pole portion 53 of the iron core 52 to each of the fixed contacts 22*a*, 23*a*, and high insulating properties can thus be obtained.

Further, the insulating rib 72 may be disposed so as to cut off the shortest-distance straight line connecting between the tip edge of the insulating rib 46 and the magnetic pole portion 53. This can lead to an increase in spatial distance from the magnetic pole portion 53 of the iron core 52 to each of the fixed contacts 22*a*-23*a*, and higher insulating properties can thus be obtained.

Note that a length dimension of the insulating rib 46 projecting from the outward surface of the flange portion 42 is preferably a length dimension that is smaller than a distance from the outward surface of the flange portion 42 to the tip of each of the fixed contacts 22*a*, 23*a*. This is because, if the length dimension of the insulating rib 46 is a length dimension that is larger than the distance from the outward surface of the flange portion 42 to the tip of each of the fixed contacts 22*a*, 23*a*, operation of the movable contact pieces 80, 81 might be hindered. As another reason, the arcs respectively generated between the fixed contacts 22*a*, 23*a* and the movable contacts 86*b*, 87*a* are more likely to hit against the insulating rib 72, causing the insulating rib 72 to easily deteriorate. Accordingly, a more preferable length dimension of the insulating rib 46 is a length dimension from the outward surface of the flange portion 42 to the outward surface of each of the fixed contact terminals 22, 23.

As shown in FIGS. 3 and 4, the cover 90 has a box shape that can be fitted to the base 10 with the electromagnetic block 40 assembled therein. A pair of gas releasing holes 91, 91 is provided on the ceiling surface of the cover 90. Further, in the cover 90, engagement receiving portions 92 to be engaged with the engaging claw portions 10*a* of the base 10 are provided on the facing inner side surface, and position regulation ribs 93 (FIG. 5B) are provided to project from the ceiling inner surface.

Figure 5A:
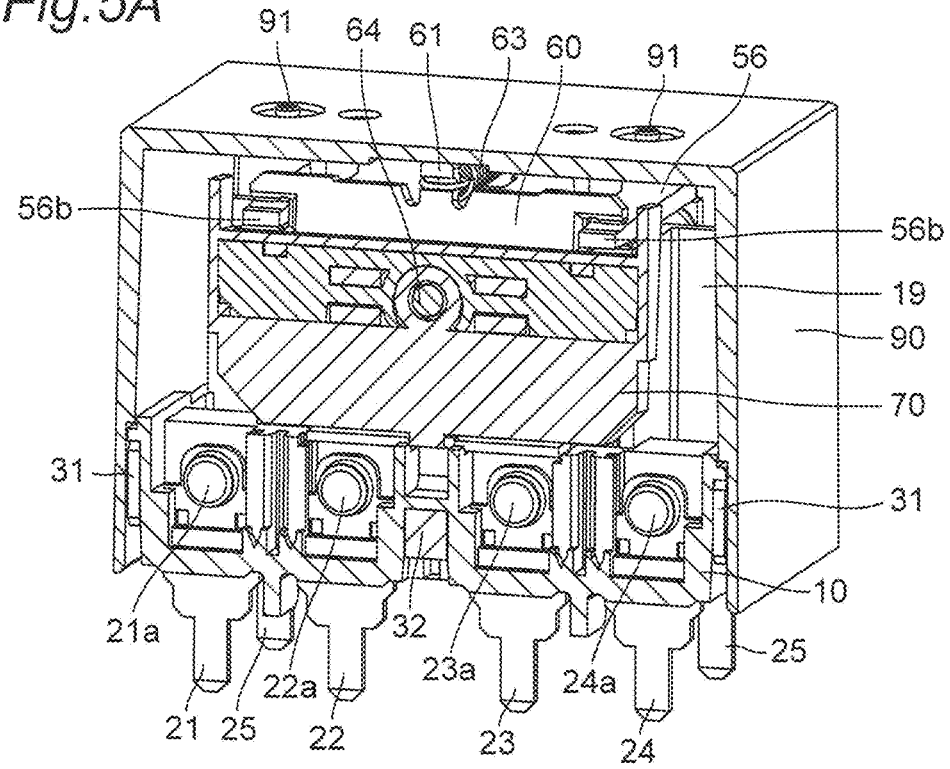
FIGS. 5A and 5B are lateral sectional views obtained by cutting the electromagnetic relay at different positions.
Figure 5B:
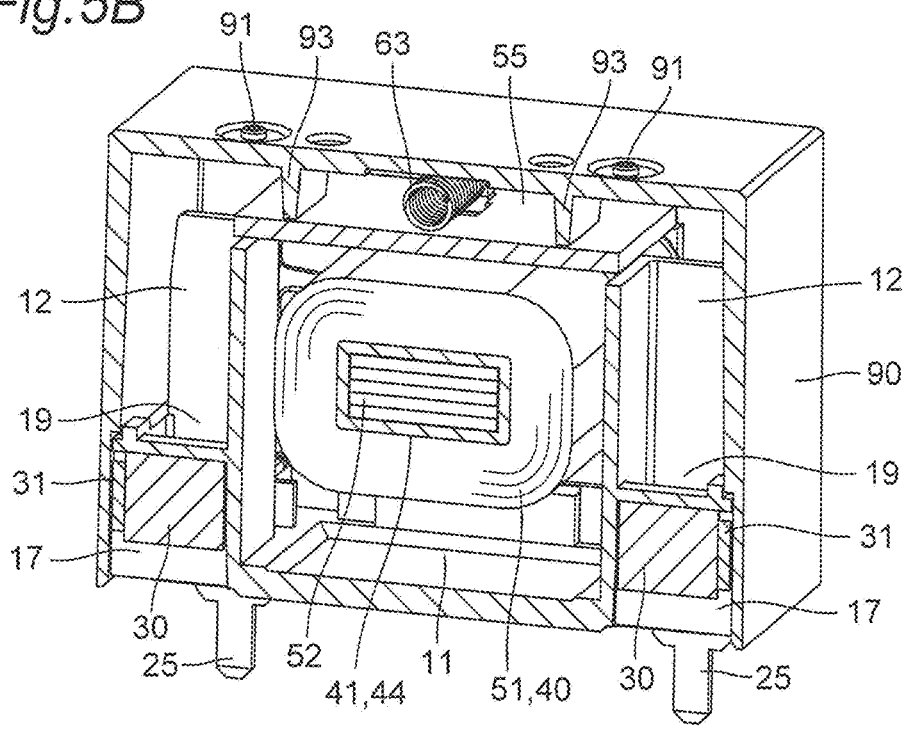

Thus, when the cover 90 is fitted to the base 10 with the electromagnetic block 40 assembled therein, the engagement receiving portion 92 of the cover 90 is engaged and fixed to the engaging claw portion 10*a* of the base 10. The position regulation ribs 93 then come into contact with the horizontal portion 56 of the yoke 55 to regulate lifting of the electromagnetic block 40 (FIG. 5B). Next, by hermetically sealing the base 10 and the cover 90 by injecting and solidifying a sealing material (not shown in the drawing) on a lower surface of the base 10, an assembling operation is completed.

In the present embodiment, the sealing material is injected to enable the first and second permanent magnets 30, 32 and the auxiliary yoke 31 to be fixed onto the base 10, while simultaneously sealing a gap between the base 10 and the cover 90. Thus, according to the present embodiment, it is possible to obtain an electromagnetic relay taking a small number of operation steps and having high productivity.

Next, the operation of the above embodiment is described.

When the electromagnetic block 40 is not excited, as shown in FIGS. 7A to 8B, the movable iron piece 60 is biased clockwise by the spring force of the restoring spring 63. Hence, the movable contacts 86*a*, 86*b*, 87*a*, 87*b* are respectively separated from the fixed contacts 21*a*, 22*a*, 23*a*, 24*a*.

Figure 9A:
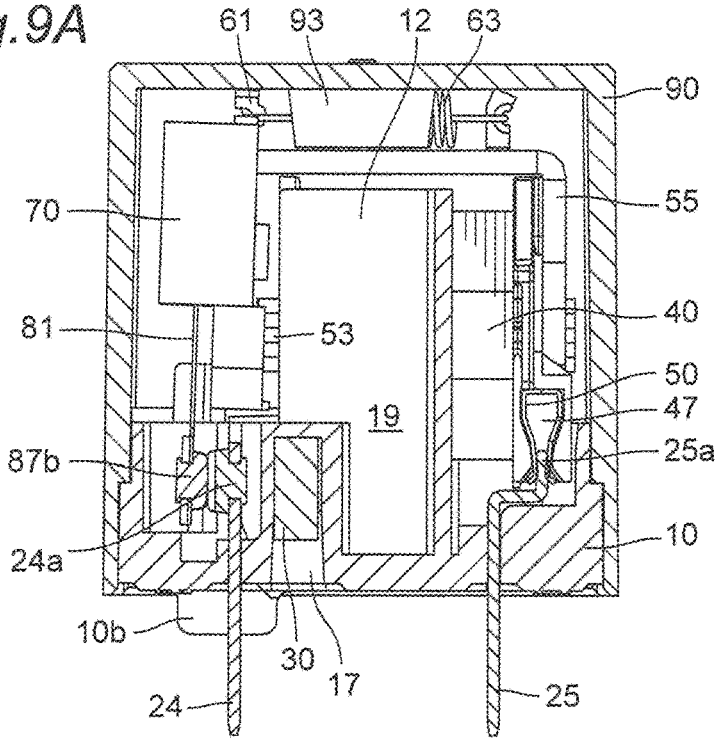
FIGS. 9A and 9B are longitudinal sectional, views obtained by cutting the electromagnetic relay at different positions after operation.
Figure 9B:
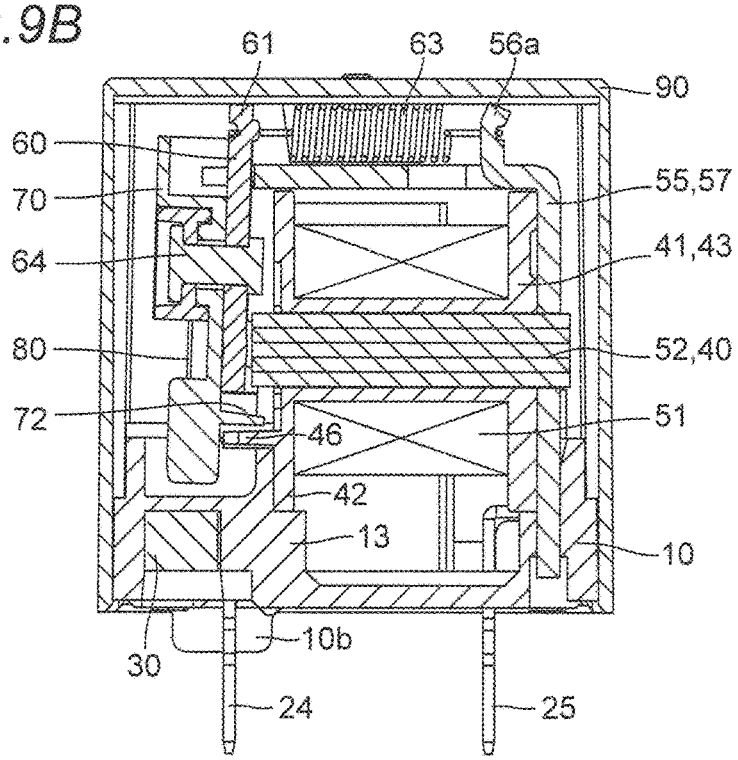

When a voltage is applied to the coil 51 for excitation, the movable iron piece 60 is attracted to the magnetic pole portion 53 of the iron core 52, and the movable iron piece 60 rotates clockwise against the spring force of the restoring spring 63. For this reason, the movable contact pieces 80, 81 rotate together with the movable iron piece 60, and the movable contacts 86*a*, 86*b*, 87*a*, 87*b* respectively come into contact with the fixed contacts 21*a*, 22*a*, 23*a*, 24*a*. Thereafter, the movable iron piece 60 is attracted to the magnetic pole portion 53 of the iron core 52 (FIGS. 9A and 9B).

Subsequently, when the application of the voltage to the coil 51 is stopped, the movable iron piece 60 rotates clockwise by the spring force of the restoring spring 63, and the movable iron piece 60 is separated from the magnetic pole portion 53 of the iron core 52. Thereafter, the movable contacts 86*a*, 86*b*, 87*a*, 87*b* are respectively separated from the fixed contacts 21*a*, 22*a*, 23*a*, 24*a* to return to the original state.

According to the present embodiment, as shown in FIGS. 6A to 7B, even when an arc 110 is generated at the time of separation of the movable contacts 86*a*, 87*b* from the fixed contacts 21*a*, 24*a*, the magnetic force lines of the first permanent magnet 30 can act on the arc 11C) via the auxiliary yoke 31. Thus, based on the Fleming's left hand rule, the generated arc 110 is attracted by the Lorentz force to the arc extinguishing space 19 of the base 10, to be extended and extinguished.

According to the present embodiment, the arc 110 can be attracted to the oblique backward of the fixed contacts 21*a*, 24*a* and extinguished only by the first permanent magnet 30. The oblique backward of the fixed contacts 21*a*, 24*a* here means a direction that, as seen from the fixed contacts 21*a*, 24*a*, is opposite to the facing movable contacts 86*a*, 87*b*, and in the direction opposite to the base.

Further, by disposing the auxiliary yoke 31, the arc 110 can be attracted in a right and left direction, to adjust the attracting direction. The right and left direction of the arc 110 means a direction vertical to a direction in which the fixed contacts 21*a*, 24*a* and the movable contacts 86*a*, 87*b* face each other, as well as a direction parallel to the upper surface of the base.

Thus, according to the present embodiment, the generated arc 110 does not come into contact with the inner surface of the cover 90 and the electromagnetic block 40, to thereby be extended obliquely backward in an appropriate direction. This enables more effective extinguish of the arc 110.

According to the present embodiment, there is an advantage that an increase in size of the apparatus can be avoided since the dead space located behind each of the fixed contacts 21*a*, 24*a* is effectively used as the arc extinguishing space 19.

Needless to say, the shapes, sizes, materials, disposition, and the like of the first and second permanent magnets 30, 32 and the auxiliary yoke 31 are not restricted to those described above, but can be changed as necessary.

WORKING EXAMPLE 1

A working example 1 is an analysis of directions and strength of the magnetic force lines in the case of combining the first and second permanent magnets 30, 32 with the auxiliary yoke 31.

Figure 14A:
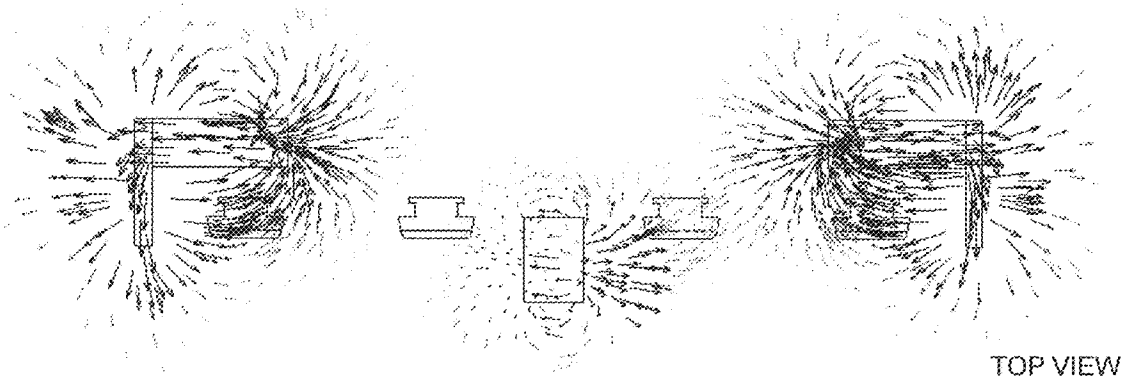
FIGS. 14A and 14B are a plan view and a front view showing, with vector lines, magnetic force lines of permanent magnets of an electromagnetic relay according to a working example 1.
Figure 14B:
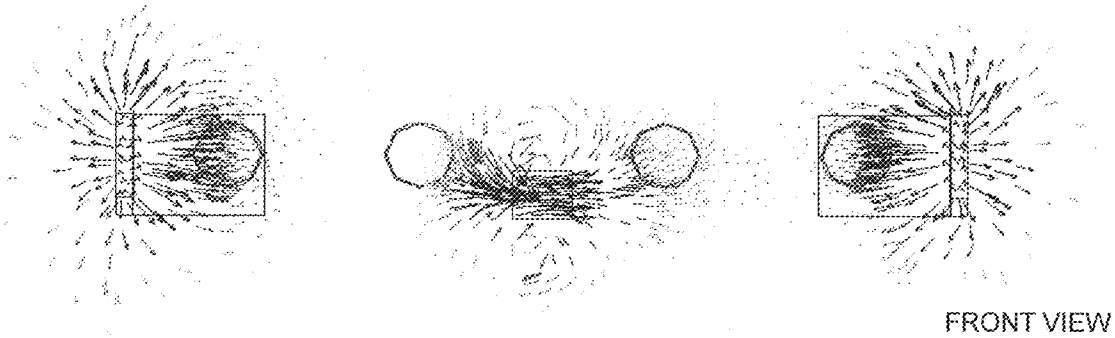
Figure 15A:
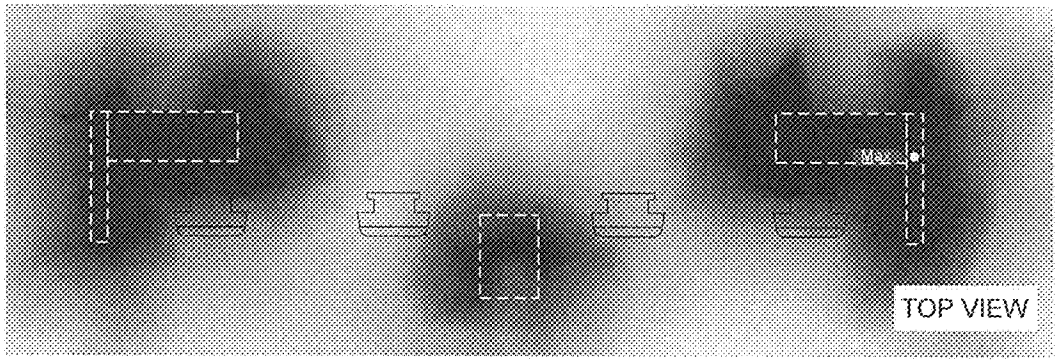
FIGS. 15A and 15B are a plan view and a front view showing, with concentration, magnetic flux densities of the permanent magnets of the electromagnetic relay according to the working example 1.
Figure 15B:
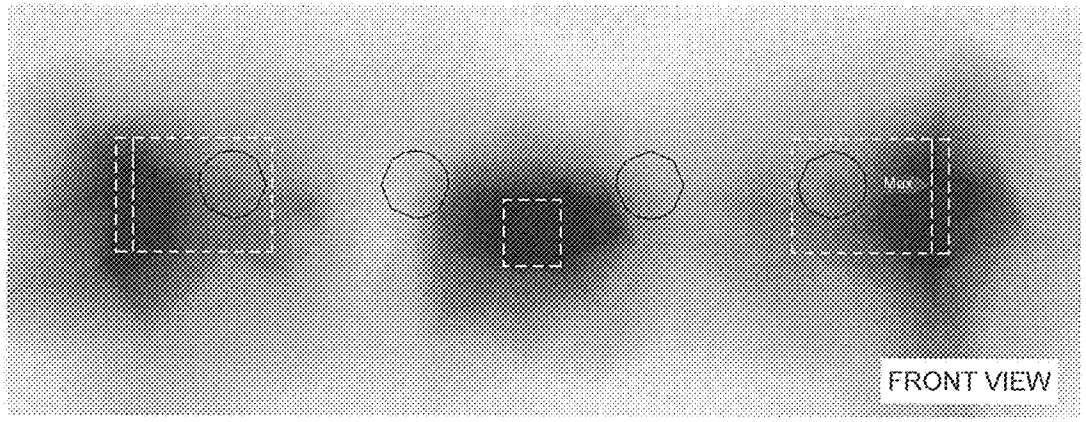

As an analysis result, the directions of the magnetic force lines are shown by vector lines (FIGS. 14A and 14B), and the strength of the magnetic force lines is shown by concentration (FIGS. 15A and 15B).

WORKING EXAMPLE 2

A working example 2 is an analysis of directions and strength of the magnetic force lines in the case of disposing the components in the same manner as in the working example 1 described above except for not providing the auxiliary yoke 31.

Figure 16A:
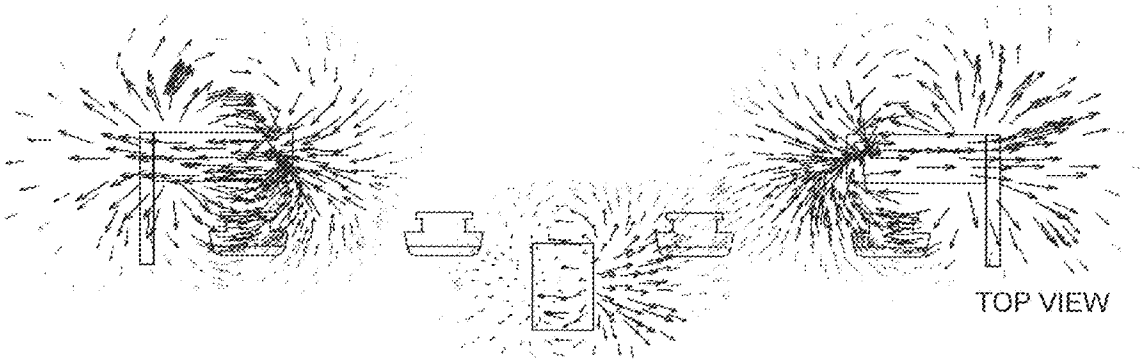
FIGS. 16A and 16B are a plan view and a front view showing, with vector lines, magnetic force lines of permanent magnets of an electromagnetic relay according to a working example 2.
Figure 16B:
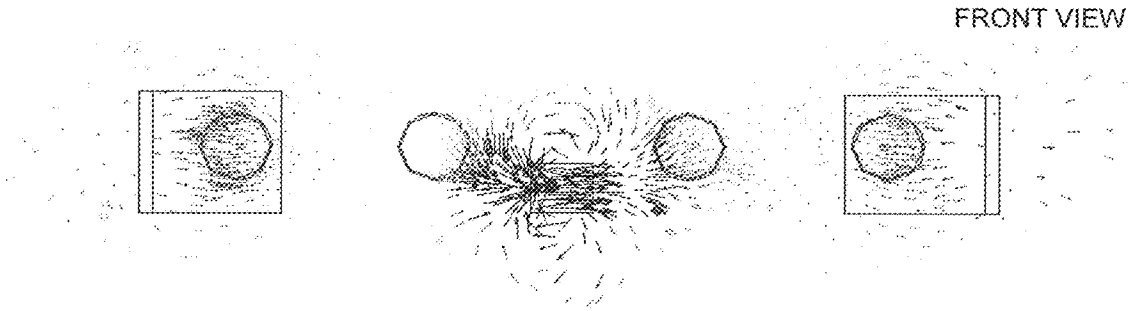
Figure 17A:
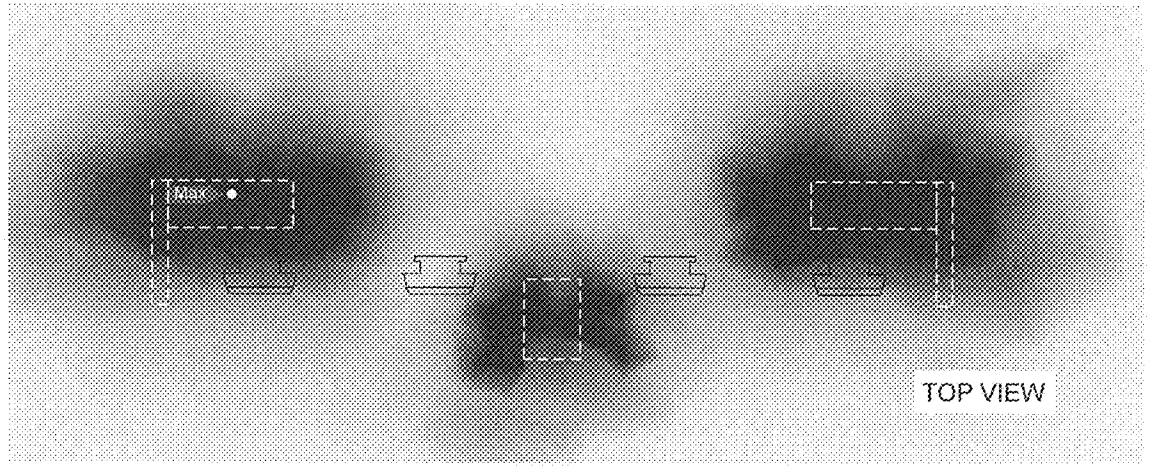
FIGS. 17A and 17B are a plan view and a front view showing, with concentration, magnetic flux densities of the permanent magnets of the electromagnetic relay according to the working example 2.
Figure 17B:
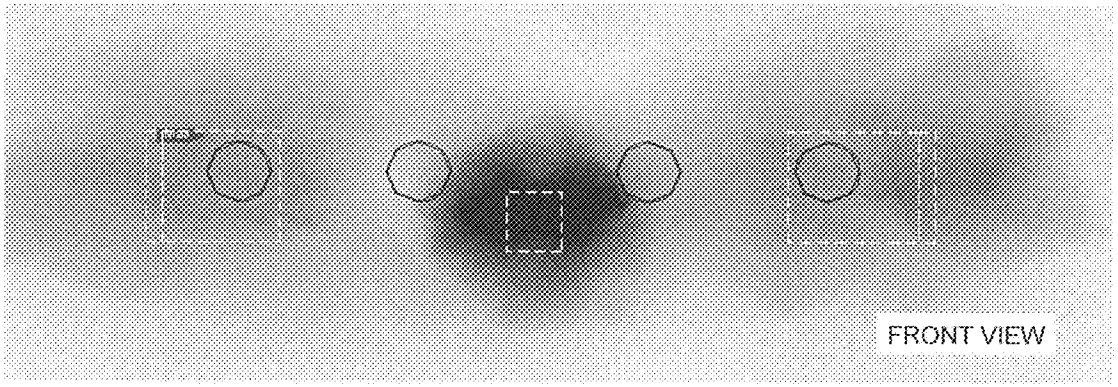

As an analysis result, the directions of the magnetic force lines are shown by vector lines (FIGS. 16A and 16B), and the strength of the magnetic force lines is shown by concentration (FIGS. 17A and 17B).

It could be confirmed from FIGS. 14A to 15B as to how and to what extent the magnetic force lines of the first and second permanent magnets 30, 32 act on the fixed contacts 21*a*, 22*a*, 23*a*, 24*a* and the movable contacts 86*a*, 86*b*, 87*a*, 87*b*.

Further, it could be confirmed, by comparing the results described in FIGS. 14A to 15B with the results described in FIGS. 16A to 17B, that provision of the auxiliary yoke 31 leads to changes in directions of the magnetic force lines of the permanent magnets and distribution of the strength of the magnetic force lines.

INDUSTRIAL APPLICABILITY

The present invention is not restricted to the DC electromagnetic relay, but may be applied to an AC electromagnetic relay.

Although the cases of applying the present invention to the electromagnetic relay with the four poles have been described in the above embodiments, this is not restrictive, and it may be applied to an electromagnetic relay with at least one pole.

Further, the present invention is not restricted to the electromagnetic relay, but may be applied to a switch.

REFERENCE SIGNS LIST

10: base
10*a*: engaging claw portion
11: recessed portion
12: partition wall
13: stepped portion
14: press-fitting hole
15*a*,15*b*,15*c*,15*d*: terminal hole
16*a*,16*b*: terminal hole
17: notched groove
18: recessed portion
19: arc extinguishing space
21-24: fixed contact terminal
21*a*-24*a*: fixed contact
25: coil terminal
25*a*: connection portion
25*b*: terminal portion
30: first permanent magnet
31: auxiliary yoke
32: second permanent magnet
35: magnetic field generation unit
40: electromagnetic block
41: spool
42-43: flange portion
44: trunk portion
45: through hole
47: engaging hole
50: relay clip
52: iron core
53: magnetic pole portion
55: yoke
60: movable iron, piece
70: spacer
72: insulating rib
73: insulating rib
74: movable stage
80: movable contact piece
81: movable contact, piece
82: large width portion
83: large width portion
84: lining member
85: lining member
86*a*,86*b*: movable contact
87*a*,87*b*: movable contact
90: cover
91: gas releasing hole
92: engagement receiving portion
93: position regulation rib
100: arc cut-off member
101: projection
102: rib
103: rib
104: tongue member
110: arc

The invention claimed is:

1. An electromagnetic relay comprising:

a base;

an electromagnetic block disposed on an upper surface of the base;

a movable iron piece that rotates based on excitation and non-excitation of the electromagnetic block;

a movable contact piece that rotates integrally with the movable iron piece;

a movable contact fixed to a free end of the movable contact piece;

a fixed contact disposed so as to come into or out of contact with the movable contact in association with rotation of the movable contact piece; and a magnetic field generation unit disposed so as to attract an arc generated between the movable contact and the fixed contact in a direction that, as seen from the fixed contact or the movable contact, is opposite to a facing movable contact or a facing fixed contact, and in a direction opposite to the base, wherein, the movable contact piece has a substantially T-shape with a large width portion at a tip, and a plurality of the movable contacts are each fixed to the free end of the large width portion.

2. The electromagnetic relay according to claim 1, wherein the magnetic field generation unit is made up of a permanent magnet and an auxiliary yoke, and the auxiliary yoke is disposed so as to be adjacent to the permanent magnet, while the permanent magnet is disposed in a direction in which the fixed contact and the movable contact come into and out of contact with each other.

3. The electromagnetic relay according to claim 2, wherein an arc extinguishing space is disposed on the upper surface of the base, the space being located in a direction that, as seen from the fixed contact or the movable contact, is opposite to a facing movable contact or a facing fixed contact.

4. The electromagnetic relay according to claim 1, wherein an arc extinguishing space is disposed on the upper surface of the base, the space being located in a direction that, as seen from the fixed contact or the movable contact, is opposite to a facing movable contact or a facing fixed contact.

5. The electromagnetic relay according to claim 4, wherein the arc extinguishing space is formed between a partition wall provided on the upper surface of the base and a terminal hole for disposing on the base a fixed contact terminal on which the fixed contact is disposed.

6. The electromagnetic relay according to claim 5, wherein a metal arc cut-off member is disposed in the arc extinguishing space.

7. The electromagnetic relay according to claim 4, wherein a metal arc cut-off member is disposed in the arc extinguishing space.

8. The electromagnetic relay according to claim 1, wherein the magnetic field generation unit is made up of a permanent magnet and an auxiliary yoke, and the auxiliary yoke is disposed so as to be adjacent to the permanent magnet, while the permanent magnet is disposed in a direction in which the fixed contact and the movable contact come into and out of contact with each other.

9. The electromagnetic relay according to claim 1, wherein an arc extinguishing space is disposed on the upper surface of the base, the space being located in a direction that, as seen from the fixed contact or the movable contact, is opposite to a facing movable contact or a facing fixed contact.

10. An electromagnetic relay comprising:

a base;

an electromagnetic block disposed on an upper surface of the base;

a movable iron piece that rotates based on excitation and non-excitation of the electromagnetic block;

a movable contact piece that rotates integrally with the movable iron piece;

a movable contact fixed to a free end of the movable contact piece;

a fixed contact disposed so as to come into or out of contact with the movable contact in association with rotation of the movable contact piece; and a magnetic field generation unit disposed so as to attract an arc generated between the movable contact and the fixed contact in a direction that, as seen from the fixed contact or the movable contact, is opposite to a facing movable contact or a facing fixed contact, and in a direction opposite to the base, wherein the electromagnetic relay further comprises:

a plurality of pairs of the movable contacts and the fixed contacts;

a first magnetic field generation unit disposed so as to attract an arc generated between a first movable contact and a first fixed contact in a direction that, as seen from the first movable contact or the first fixed contact, is opposite to a facing first fixed contact or a facing first movable contact, and in a direction opposite to the base; and a second magnetic field generation unit disposed so as to attract an arc generated between a second movable contact and a second fixed contact and an arc generated between a third movable contact and a third fixed contact in an opposite direction to each other.

11. The electromagnetic relay according to claim 10, wherein the second movable contact and the third movable contact, and the second fixed contact and the third fixed contact, are disposed so as to respectively be adjacent to each other, and the second magnetic field generation unit attracts the arc generated between the second movable contact and the second fixed contact toward the upper surface of the base, and attracts the arc generated between the third movable contact and the third fixed contact in a direction opposite to the upper surface of the base.

* * * * *